United States Patent [19]

Hill et al.

[11] Patent Number: 4,954,086

[45] Date of Patent: Sep. 4, 1990

[54] FLOAT/GUIDE MEMBER FOR CARD EDGE CONNECTOR

[75] Inventors: Edward W. D. Hill; William P. Buckley, both of Toronto; Robert Hennessey, Ajax, all of Canada

[73] Assignee: Burndy Corporation, Norwalk, Conn.

[21] Appl. No.: 370,590

[22] Filed: Jun. 21, 1989

[51] Int. Cl.[5] ..... H01R 13/629

[52] U.S. Cl. ..... 439/65; 439/381

[58] Field of Search ..... 439/64, 65, 246, 251, 439/380, 381, 629, 247

[56] References Cited

U.S. PATENT DOCUMENTS

| | | | |
|---|---|---|---|
| 3,008,113 | 11/1961 | Johnson . | |
| 3,193,791 | 6/1965 | Bock et al. . | |
| 3,264,598 | 8/1966 | Phelps et al. . | |
| 3,850,492 | 11/1974 | Moore . | |
| 3,864,000 | 2/1975 | Coller et al. | 439/246 |
| 4,204,737 | 5/1980 | Faber et al. . | |
| 4,209,216 | 6/1980 | Brooks . | |
| 4,533,203 | 8/1985 | Feldman et al. | 439/64 |
| 4,538,866 | 9/1985 | Johnson | 439/64 |
| 4,609,243 | 9/1986 | Wyss . | |
| 4,776,805 | 10/1988 | Brown et al. . | |

*Primary Examiner*—Gary F. Paumen

*Attorney, Agent, or Firm*—Mitchell B. Wasson; Martin P. Hoffman; Burtsell J. Kearns

[57] ABSTRACT

A float/guide member is provided with contact receiving cavities for receiving the contact members of an electrical connector. The contact receiving cavities are provided with a portion which is oversized with respect to the size of the contact members, thereby allowing the electrical connector to float laterally with respect to the float/guide member by floating or bending of the contact members within the enlarged portions of the contact receiving cavities.

4 Claims, 2 Drawing Sheets

FIG. 1.
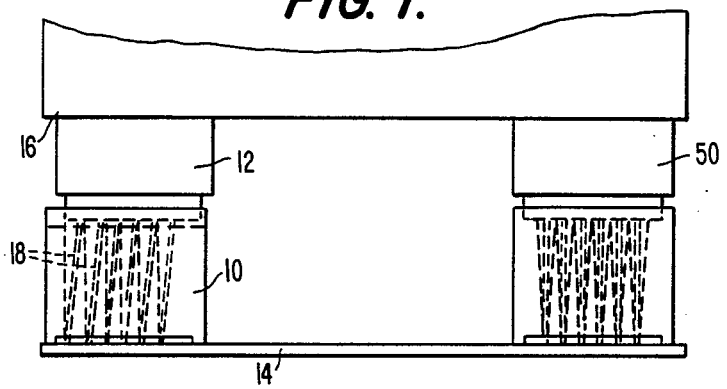
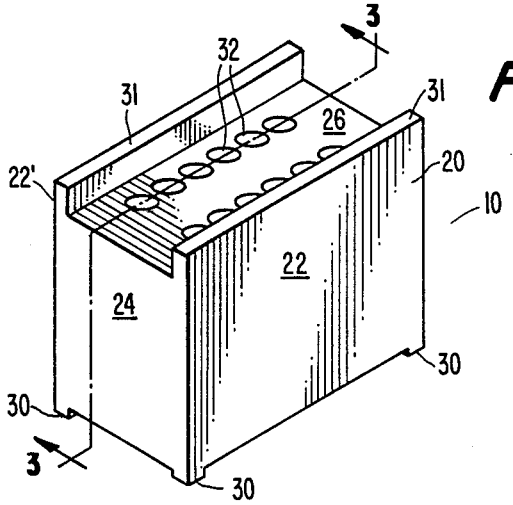
FIG. 2.
FIG. 3.
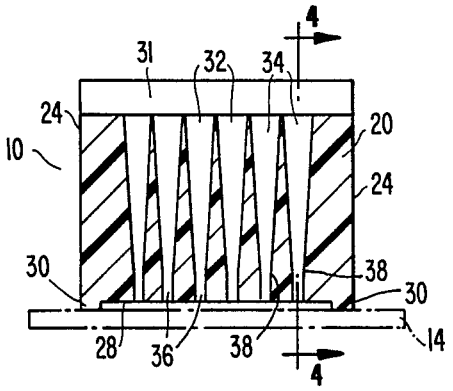
FIG. 4.
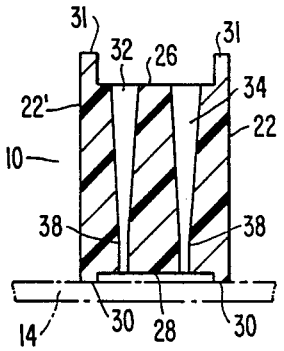

FLOAT/GUIDE MEMBER FOR CARD EDGE CONNECTOR

BACKGROUND OF THE INVENTION

1. Field of the Invention

The invention relates generally to a float/guide member which is adapted to be mounted between a mother printed circuit board and a card edge connector. More particularly, the invention pertains to a float/guide member which is uniquely adapted to receive the contact pins of the edge connector, allowing the pins to extend through the float/guide member and into the mother printed circuit board, whereby the card edge connector is able to move or float laterally on its contact pins with respect to the mother printed circuit board. The latter characteristic allows a daughter board associated with the card edge connector to be properly aligned and mated with a second card edge connector mounted remotely either on the mother printed circuit board or on a separate printed circuit board.

A typical problem attendant with mother printed circuit boards provided with an in-line series of fixed card edge connectors is that they exceed the pad width tolerances on daughter boards and, when a daughter board is plugged into the connectors, open and shorted daughter board connections are apt to occur. When tighter tolerance pitch connectors, such as a 2×120 0.050 inch pitch card edge connector, is placed in-line with a smaller card edge connector, such as a 2×6 0.100 inch pitch connector, the problem of daughter board connections is even more prevalent, as is the case where one daughter board plugs into two card edge connectors on different printed circuit boards.

The subject invention addresses and overcomes the foregoing problems by providing means enabling a card edge connector to float laterally, so that a single daughter board can plug into in-line card edge connectors of different pitch, as well as into card edge connectors of different printed circuit boards. The invention accomplishes this objective by providing a float/guide member which is adapted to be disposed between a 2×6 0.100 inch pitch connector and a mother printed circuit board. The float/guide member includes a plurality of contact receiving cavities, into which the card edge connector pin contacts are intended to be press fit inserted.

Each of the contact pins extends through a narrow opening at the bottom of its contact receiving cavity in the float/guide and into a mother printed circuit board, being soldered thereto. The contact receiving cavities in the float/guide member are enlarged above the narrow bottom opening, whereby the contacts are able to bend or float within their contact receiving cavities. The invention contemplates lengthening the card edge connector pin contacts, and thinning the contact beam perpendicular to the direction of the float. Thinning and extending the card edge connector contacts allows the lateral float movement without additional mechanical or solder connections.

The float/guide member thus allows the card edge connector with which it is associated to move or float laterally on its thinned contact pins, generally around ±0.05 inch. Raised parallel side rails provided on the upper portion of the float/guide member prevent movement of the card edge connector perpendicular to the transverse plane so as to minimize stress on the thinned pin contacts. Moreover, maximum lateral movement of the card edge connector is defined by the size of the oversized contact receiving cavities, thereby limiting contact fatigue.

When the card edge of a daughter printed circuit board is vertically inserted into the card edge connector, lateral floating of the card edge connector made possible by the float/guide enables the daughter printed circuit board to be properly aligned with and plugged into a second, different pitch card edge connector mounted on the mother printed circuit board in-line with the first edge connector. Additionally, the capability of the first card edge connector for lateral float permits the daughter printed board to be plugged into a second card edge connector mounted on a second, different printed circuit board.

2. Description of the Prior Art

It is known in the prior art to provide edge connectors for printed circuit boards. Examples of such connectors are disclosed in U.S. Pat. No. 3,008,113, U.S. Pat. No. 3,193,791 and U.S. Pat. No. 3,264,598.

U.S. Pat. No. 3,264,598, which issued on Aug. 2, 1966 to Phelps et al. discloses a connector which extends longitudinally along the adjoining longitudinal edges of a pair of circuit boards and is provided with a slot for receiving an edge of each of the circuit boards.

U.S. Pat. No. 3,008,113, which issued to Johnson on Nov. 7, 1961, shows a receptacle which receives a pluggable printed circuit board and which is electrically connected to a second printed circuit board.

U.S. Pat. No. 3,193,791 to Bock et al., bearing an issue date of Jul. 6, 1965, teaches a receptacle provided with a card receiving cavity for receiving the terminal end of a printed circuit board.

The prior art further discloses a card edge connector characterized by a wedge which serves to bias a card edge inserted into the connector against the far end wall of the card receiving slot. As shown in U.S. Pat. No. 4,766,805 of Oct. 11, 1988 to Brown et al., a nose provided on the wedge biases the card edge, and a spring associated with the wedge urges the wedge away from the backplane on which the connector is mounted.

It is also known in the prior art to provide an adapter for a card edge connector to accommodate a warped card edge. U.S. Pat. No. 4,204,737, for example, which issued on May 27, 1980 to Faber et al., discloses a molded plastic adapter having a first slot for receiving a terminal support block, and a second slot defined by opposing guide portions for receiving and straightening a warped leading edge of a substrate.

Finally, the prior art teaches a connector system for interconnecting two modules characterized by a pin guide which reduces the tolerance mismatch of the pins associated with two different modules. In particular, Moore, U.S. Pat. No. 3,850,492 dated Nov. 26, 1974, shows a pin guide having funnel-shaped entrance passageways to allow reception of male pins despite a mismatch between the modules. Moore is further characterized in that receptacles in the female connector are adapted to float within the connector.

The prior art fails to teach or suggest a float/guide member inserted between a card edge connector and a printed circuit board and being adapted to receive the pin contacts of the card edge connector whereby the card edge connector is able to float laterally on its contacts with respect to the printed circuit board and the float/guide member.

SUMMARY OF THE INVENTION

The invention relates to a float/guide member which is adapted to be inserted between a card edge connector and a mother printed circuit board for allowing the card edge connector to move laterally with respect to the mother printed circuit board.

The float/guide member includes an insulative body having a plurality of contact receiving cavities, each of which extends through said body from a first contact receiving opening in said body to a second contact projecting opening in said body member. The card edge connector is intended to be associated with the body member so that each of the pin contact members of the card edge connector enters the float/guide member through a contact receiving opening, extends through a respective contact receiving cavity in the body member, and projects from the body member through a respective one of the contact projecting openings for solder connection to a mother printed circuit board.

Each of the contact receiving cavities is particularly designed such that its contact receiving opening and the portion of the cavity extending from the contact receiving opening to proximate the contact projecting opening is oversized or enlarged with respect to the size of the pin contact member which it receives. The portion of the contact receiving cavity which is proximate to the contact projecting opening is not oversized, however, but is sized so as to relatively snugly receive the contact member further minimizing mechanical stress on the solder joints.

The enlarged portion of the contact receiving cavities allows the card edge connector to be moved laterally on its contacts with respect to the float/guide member and the mother printed circuit board by allowing the contact members to bend or float laterally within the enlarged portions of their contact receiving cavities. When a daughter board is electrically connected to the card edge connector, floating the card edge connector allows the daughter board to be electrically associated with a second card edge connector located on the mother board or on a different printed circuit board.

BRIEF DESCRIPTION OF THE DRAWINGS

FIG. 1 illustrates a front plan view of the float/guide member of the present invention as it appears when mounted between a card edge connector and a mother printed circuit board, and showing a second guide member mounted between a second card edge connector and the mother printed circuit board at a spaced location from the first float/guide member;

FIG. 2 is a perspective view of the float/guide member;

FIG. 3 is a front cross-sectional view of the float/guide member taken along line 3—3 of FIG. 2;

FIG. 4 is a side cross-sectional view of the float/guide member taken along line 4—4 of FIG. 3;

DESCRIPTION OF THE PREFERRED EMBODIMENT

Figure 5:
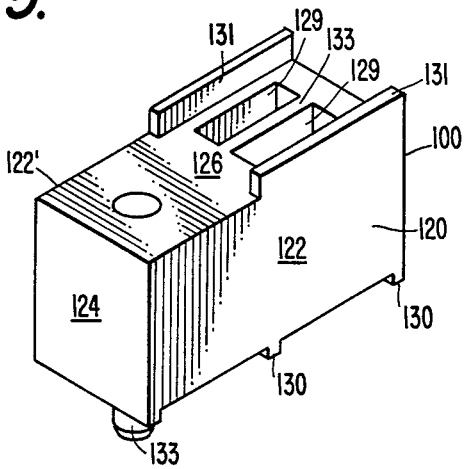
FIG. 5 is a perspective view of a first alternative embodiment for the float/guide member.

With reference to the drawings, and, in particular, with reference to FIGS. 1–4, the preferred embodiment for a float/guide member according to the principles of the present invention is shown generally at 10. As illustrated in FIG. 1, the float/guide member 10 is intended to be inserted between a card edge connector 12 and a mother printed circuit board 14. The card edge connector, in turn, is electrically associated with a daughter printed circuit board 16 oriented vertically in a slot in the card edge connector. As further shown in FIG. 1, the card edge connector includes a plurality of pin contacts 18 which, when the card edge connetor is mounted on the float/guide member, extend completely through the float/guide member and project from the bottom thereof. The ends of the pin contacts which project from the bottom of the float/guide member extend into the mother printed circuit board, being electrically connected to the mother board by solder connections.

As is most clearly shown in FIGS. 2–4, the float/guide member 10 comprises a body 20 fabricated of an insulative material, preferably a glass-filled polyester. The body 20 is defined by parallel front and rear walls 22 and 22' side walls 24, top wall 26 and bottom wall 28, which together form a generally rectangular configuration. Support members 30 project from the bottom wall 28, by means of which the body may be supported upon the mother printed circuit board with the bottom wall 28 slightly raised above the mother board as shown in FIG. 1. The support members 30 provide a solder wash standoff for the body when the projecting ends of the contact members 18 are soldered to the mother printed circuit board. The parallel front and rear sides of top wall 26 are each provided with an upstanding side rail 31.

Top wall 26, as illustrated in FIG. 2, is provided with a plurality of openings 32. As best depicted in FIGS. 3 and 4, openings 32 lead into contact receiving cavities 34 formed in the body 20. Each of the cavities 34 extends vertically through the body from the top wall 26 to the bottom wall 28, tapering inwardly and downwardly from the top to the bottom walls.

As previously discussed in conjunction with FIG. 1, the float/guide member 10 is intended to be utilized in conjunction with a card edge connector 12 and, preferably, with a $2\times6$ 0.100 inch pitch card edge connector having a total of twelve pin contacts 18. In order for the pin contacts 18 to be accommodated by the float/guide member, the present invention contemplates lengthening and thinning the associated card edge connector contacts. In particular, the card edge lead is intended to be lengthened to around 0.75 inch, and the contact beam is thinned perpendicular to the direction of float, the direction of float being in the lateral direction parallel to the side rails 31.

With reference to FIG. 1, it can be seen that the card edge connector 12 is adapted to be inserted and snugly received between the upstanding parallel rails 30 of the float/guide member. The contact members 18 are intended to be press fit into the float/guide member, each of the contacts extending into a respective contact receiving cavity 34, whereupon each of the contact members projects from a bottom opening 36 in the bottom wall 28 of the float/guide member into the mother printed circuit board for soldering thereto.

The pin contacts 18 are preferably rectangular, being approximately 0.025 inch × 0.011 inch, the contact beam having been reduced perpendicular to the direction of float. It can be seen in FIGS. 2–4 that the openings 32 and the contact receiving cavities 34 are circular in configuration which, when receiving the rectangular pin contacts 18, ensures washing. It is also evident from FIGS. 2–4, that the openings 32 to the contact receiving cavities are oversized with respect to the size of the contact members, the openings preferably being around 0.09 inch in diameter. Each of the contact receiving cavities tapers inwardly and downwardly from this 0.09 inch diameter opening to 0.028 inch in diameter at approximately location 38, slightly above the bottom opening 36. The contact receiving cavities are a constant 0.028 inch diameter from the location 38 to the bottom openings 36.

Thus, it can be seen that the contact members 18 are relatively snugly received within the contact receiving cavities from location 38 down to the bottom openings. From location 38 upward, however, the enlarged area of the contact receiving cavities allows the contact members to bend or float laterally in their contact receiving cavities in the lateral direction when the card edge connector is moved laterally along the top wall 26 of the float/guide member. The degree of float permitted by the float/guide member as described is in the nature of ±0.03 inch in the lateral direction.

By allowing the card edge connector 12 to float laterally, the daughter printed circuit board 16 associated with the card edge connector is able to be properly aligned and similarly mated with a second card edge connector 50, as shown in FIG. 1. The second card edge connector 50 may be the same as or of a different pitch than the card edge connector 12, the invention having particular application where the second card edge connector 50 is a 2×120 0.050 inch pitch card edge connector. Although FIG. 1 shows the second card edge connector as being associated with the mother printed circuit board 14, it should be understood that the second card edge connector may be electrically connected to a second different printed circuit board, thereby allowing a single daughter board to be connected to two different printed circuit boards.

The invention is characterized in that the thinning and extending of the card edge connector contacts permits lateral movement of the card edge connector on its contacts without any extraneous mechanical or solder connections. Press fit of the contact members in the float/guide member transfers stress from the solder joint at the mother printed circuit board and defines the moment of inertia for the contact member. Stress on the thinned contact member is minimized by means of the side rails limiting movement of the card edge connector perpendicular to the transverse plane. Finally, the maximum lateral float of the card edge connector is defined by the contact receiving cavities of the float/guide member, thereby limiting contact fatigue.

A first alternative embodiment for the float/guide member is depicted in FIGS. 5–9. As shown therein, the float/guide member 100 comprises a body 120, preferably fabricated from glass-filled polyester. The body 120 is defined by front and rear walls 122 and 122', side walls 124, top wall 126 and bottom wall 128. Support members 130 project from the bottom wall 128, the purpose of which was discussed in connection with the embodiment of FIGS. 1–4. Additionally, a cylindrical projection 133 extends downwardly from the bottom wall, providing a means by which the float/guide member may be secured to a printed circuit board or to an electrical connector. The parallel front and rear sides of top wall 126 are each provided with an upstanding side rail 131.

Figure 6:
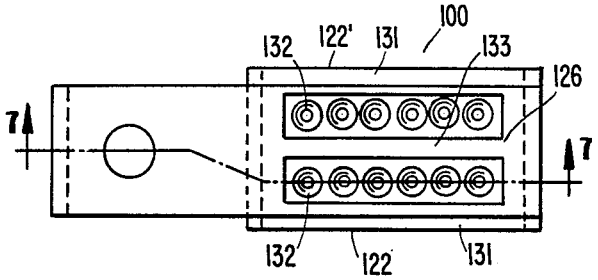
FIG. 6 is a top plan view of the float/guide member of FIG. 5.
Figure 8:
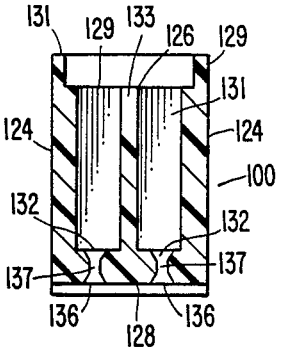
FIG. 8 is a side cross-sectional view of the float/guide member of FIG. 5, taken along line 8—8 of FIG. 7.
Figure 7:
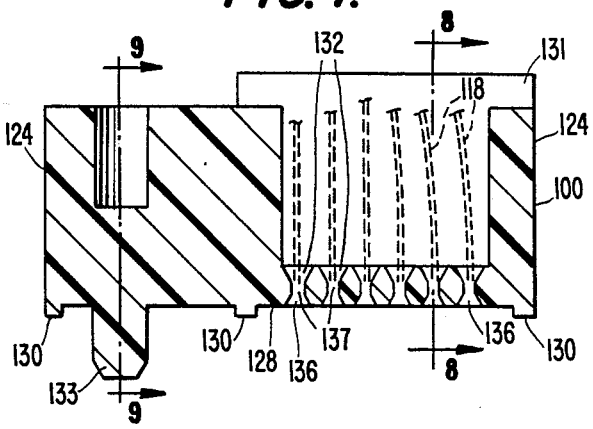
FIG. 7 is a front cross-sectional view of the float/guide member of FIG. 5, taken along line 7—7 of FIG. 6.
Figure 9:
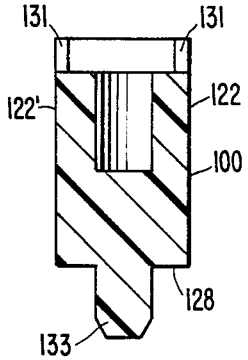
FIG. 9 is a side cross-sectional view of the float/guide member of FIG. 5, taken along line 9—9 of FIG. 7.

Top wall 126, as best depicted in FIGS. 6 and 8, is provided with a pair of parallel cavity receiving slots 129. Slots 129 are generally rectangular in cross-sectional configuration, when viewed from above, being separated from each other by a central web 133 of the body. The cavity receiving slots 129 extend from the top wall vertically downward through the body and terminate in a plurality of circular contact receiving openings 132 which are shown in FIGS. 6 and 7 as corresponding to the pin contact members 118 of a 2×6 card edge connector as was generally discussed in connection with the preferred embodiment of FIGS. 1–4. Thus, each of the slots 129 is adapted to receive an array of six contact members of a 2×6 card edge connector.

Each of the contact receiving openings 132 tapers inwardly to a second restricted contact receiving opening 137, whereupon the second openings 137 taper outwardly to bottom openings 136 from which the pin contact members are adapted to project. The inwardly and outwardly tapering arrangement may be obtained by forming the second contact receiving openings 137 in the bottom wall and providing a 60 degree chamfer in the bottom wall at the top and bottom of the openings. The float/guide member 110 is intended to be utilized in the manner discussed in connection with the float/guide member of FIGS. 1–4.

In particular, the pin contact members 118 of a card edge connector are intended to be inserted into the float/guide member through the contact receiving slots 129, such that a single contact member is received within each of the second contact receiving openings 137. The upper and lower chamfer provided for each of the openings, as well as the slots 29 present an enlarged area above and below the openings 137, whereby the contact members are able to float laterally with lateral movement of the associated card edge connector as was discussed in connection with FIGS. 1–4.

Although the invention has been described in detail in relation to a preferred and an alternative embodiment, it is to be understood that various modifications, changes or additions may be made to the invention as described herein by one of ordinary skill in the art without departing from the spirit and scope of the invention as defined in the appended claims.

What is claimed:

1. A one-piece float/guide member for directly connecting a daughter printed circuit card to a motherboard, said float/guide member having a transverse plane, comprising an insulative body member, said body member being defined by top, bottom, front, rear and side walls, a plurality of contact receiving cavities provided in said body member, each contact receiving cavity communicating with at least one first opening in said top wall, each of said contact receiving cavities communicating with a second opening in said bottom wall, a card edge connector having a plurality of thinned and lengthened pin contact members associated with said top wall, a pair of parallel upstanding rail members provided on said top wall for limiting movement of said connector perpendicular to the transverse plane of said body member, each of said contact members being received in said body member through a respective one of said first openings so as to extend within a respective one of said contact receiving cavities and to project from a respective one of said second openings and directly engage to said motherboard, said first openings being oversized with respect to said contact members, each of said contact receiving cavities having a first portion proximate said second opening for snugly receiving the contact member and a second portion extending from said first portion to said first opening which is enlarged with respect to said contact member, said daughter printed circuit board being associated with said card edge connector such that said daughter printed circuit board may be associated with a second card edge connector by floating said first card edge connector with respect to said float/guide member in the lateral direction on its contact members by allowing said contact members in said enlarged portion to bend, said daughter printed circuit board floating as a unit.

2. The float/guide member recited in claim 1 wherein each of said contact receiving cavities is circular in cross-sectional configuration and tapers inwardly and downwardly from said first opening to said first portion proximate said second opening, said tapered portion being said enlarged second portion.

3. The float/guide member recited in claim 1 wherein said first openings are circular in cross-sectional configuration and taper inwardly and downwardly to said first portion and further comprising a third portion which tapers outwardly to said second opening, and at least one contact receiving slot formed in said body member leading to said first openings.

4. The float/guide member recited in claim 1 wherein said body member is fabricated of a glass-filled polyester.

* * * * *